United States Patent [19]

Weber et al.

[11] 4,073,118

[45] Feb. 14, 1978

[54] METHOD AND APPARATUS FOR ASSEMBLING AND POCKETING SECTIONS OF PHOTOGRAPHIC FILMS

[75] Inventors: Klaus Weber; Heinz Lüdemann; Andreas Schubert; Karel Pustka, all of Munich, Germany

[73] Assignee: AGFA-Gevaert, A.G., Leverkusen, Germany

[21] Appl. No.: 740,371

[22] Filed: Nov. 10, 1976

[30] Foreign Application Priority Data

Nov. 28, 1975 Germany ..... 2553612

[51] Int. Cl.[2] ..... B65B 35/30; B65B 63/00

[52] U.S. Cl. ..... 53/23; 53/26; 53/123; 53/152; 83/90; 271/173

[58] Field of Search ..... 53/23, 26, 123, 152, 53/153, 159, 162; 83/86, 89, 90, 92; 214/6 F, 16.6; 270/58; 271/64, 173

[56] References Cited

U.S. PATENT DOCUMENTS

| | | | |
|---|---|---|---|
| 2,644,627 | 7/1953 | Newbold | 53/152 |
| 3,655,180 | 4/1972 | Holler | 53/159 X |
| 3,789,571 | 2/1974 | Tall et al. | 53/123 X |
| 3,954,165 | 5/1976 | Snyder | 53/152 X |

*Primary Examiner*—Robert Louis Spruill
*Attorney, Agent, or Firm*—Peter K. Kontler

[57] ABSTRACT

An elongated web of exposed and developed photographic film is moved lengthwise and is severed at regular intervals to yield a succession of discrete sections. Related sections (e.g., those belonging to a customer) are assembled into groups of overlapping sections, and such groups are thereupon introduced into discrete envelopes. The assembling of groups takes place in a fan-shaped magazine having a plurality of separate compartments and being movable relative to belts or analogous transporting means for successive sections of the severed film so that each section enters a different compartment. When the magazine accumulates a group of related sections, the sections are expelled from the magazine by a pusher which moves them forwardly (i.e., in the same direction in which the sections were transported to enter the magazine) or sideways and into the respective envelope. The width of each compartment decreases in the direction of forward movement of sections or at right angles to such direction. Since the sections are out of contact with each other during introduction into the magazine, raised portions around perforations or other projections of the sections cannot cause an interlacing of sections during stacking.

21 Claims, 10 Drawing Figures

METHOD AND APPARATUS FOR ASSEMBLING AND POCKETING SECTIONS OF PHOTOGRAPHIC FILMS

BACKGROUND OF THE INVENTION

The present invention relates to a method and apparatus for introducing sections of photographic films or analogous web-like flexible materials into envelopes or other types of receptacles. More particularly, the invention relates to a method and apparatus for introducing or inserting groups or stacks of film sections or the like into receptacles, e.g., into receptacles which are to be mailed to, shipped to, delivered to or picked up by customers or dealers.

Exposed photographic films which are sent or delivered to photographic processing laboratories (either by dealers who accept the films from customers, or directly from customers) are normally processed in the following way: Each film is provided with a code identifying the dealer or customer and with notches or other types of markers each of which is in register with a discrete film frame. Several films are then spliced together end-to-end to form an elongated web which is transported through a developing machine, thereupon through a copying machine which makes reproductions of all film frames or of selected film frames, and finally through a severing unit which subdivides the web into sections of predetermined length (each such section may include four, six or more frames). Related sections (i.e., those belonging to a customer) are thereupon assembled into a stack which is received in an envelope, together with the corresponding prints, and the envelope is forwarded to or picked up by the dealer or customer.

Presently known apparatus for inserting sections of exposed and developed photographic films into envelopes comprise a severing unit located immediately ahead of an envelope which is ready to receive a predetermined number of related sections. The sections are pushed seriatim into the respective envelopes. Such apparatus are not entirely satisfactory because the corners or projections of sections are likely to pentrate into the perforations of neighboring sections so that the sections cannot be readily and rapidly assembled into a stack of accurately overlapping sections. Since it is preferred to use relatively small envelopes, the making of stacks wherein the film sections are in accurate register with each other is highly desirable, especially in modern automated processing laboratories. It has been found that sections of 35-millimeter film are particularly likely to resist accurate stacking because they are often severed across the perforations so that film portions surrounding such perforations exhibit sharp edges. Similar problems arise in connection with the stacking of film sections which carry relatively wide paper strips. Such strips are attached to films for the convenience of customers, i.e., the customers can apply to strips information for the making of additional copies prior to returning the respective film sections to the dealer or directly to the laboratory.

SUMMARY OF THE INVENTION

An object of the invention is to provide a novel and improved method which can be used for accurate, rapid and reproducible stacking of sections of photographic films or the like regardless of whether the sections exhibit holes and/or sharp edges.

Another object of the invention is to provide a method which can be used with particular advantage for accurate stacking of sections of exposed and developed photographic films which are ready for insertion into envelopes or analogous receptacles.

A further object of the invention is to provide a fully automatic method which can be practiced by resorting to simple and compact apparatus.

An additional object of the invention is to provide a novel and improved apparatus for the practice of the above outlined method.

An ancillary object of the invention is to provide an apparatus which can be combined with or which may embody conventional severing means for exposed and developed photographic films.

Still another object of the invention is to provide an apparatus which can be used for the stacking of any desired number of film sections or the like, which requires a minimum of attention, and whose operation can be regulated in a simple and reliable way.

A further object of the invention is to provide a novel and improved magazine for sections of photographic films or the like which can be used in the above outlined apparatus.

Another object of the invention is to provide an apparatus which occupies little room in a processing laboratory, which can be installed in existing laboratories as a superior substitute for presently known apparatus, and whose output is a multiple of the output of conventional apparatus.

One feature of the invention resides in the provision of a method of inserting sections of elongated photographic films or the like into envelopes or analogous receptacles. The method comprises the steps of assembling successive pluralities of sections into discrete groups outside of the respective receptacles (preferably into groups each of which constitutes a stack of registering (fully overlapping) sections belonging to a given customer), and thereupon introducing each of the thus obtained groups into the respective receptacle. In other words, instead of individually pushing or otherwise inserting each section into the respective receptacle, related sections are assembled into a group outside of the receptacle and the group is thereupon inserted (preferably automatically, e.g., by means of a pusher or the like) into the associated receptacle.

The method preferably further comprises the steps of moving an elongated web-like carrier lengthwise (the carrier may constitute a single exposed and developed photographic film or a series of photographic films which are spliced together end-to-end), and subdividing the carrier into a series of portions each of which constitutes a section. As mentioned above, each group preferably consists of a plurality of related sections whereby the number of sections may but need not vary from group to group.

The assembling step preferably comprises transporting successive sections of the respective plurality of sections in a predetermined direction (preferably lengthwise if the sections are elongated), arresting successive foremost sections, and effecting a relative sidewise movement between each arrested section and the next foremost section so that the next foremost section is free to advance to a position in which it at least partially overlaps the preceding section. The just described assembling step can be carried out by resorting to a preferably fan-shaped magazine with partitions which define a plurality of discrete compartments each having an open inlet facing the transporting means and an open outlet. The magazine is movable (pivotable or shiftable) by a suitable mechanism so as to place the inlets of successive compartments into register with a section which is transported away from the severing or subdividing station, and the outlets of the compartments are preferably (but need not always be) located in front of a retractible barrier or stop which arrests a section in the respective compartment before the magazine is moved by a step to place the next compartment into receiving position. When the compartments accumulate a group of related sections, the barrier is retracted and a pusher or the like is used to expel the sections from the respective compartments by way of the outlets and directly into a receptacle which is held in position of readiness behind the barrier.

Alternatively, the magazine may be stationary and the transporting means is then constructed, assembled and mounted in such a way that it can introduce successive sections into different compartments of the magazine. The partitions of the magazine maintain the sections in the compartments out of contact with each other prior to the introducing step, i.e., prior to insertion of all sections of a group into the corresponding receptacle.

The receptacle can be positioned in such a way that the group of sections which are temporarily stored in the compartments of the magazine must move in the same direction in which the sections are transported to enter the respective compartments. Alternatively, the pusher can be used to introduce a group of sections into the associated receptacle by moving such sections at right angles or in another direction relative to the direction of transport of sections into their compartments.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
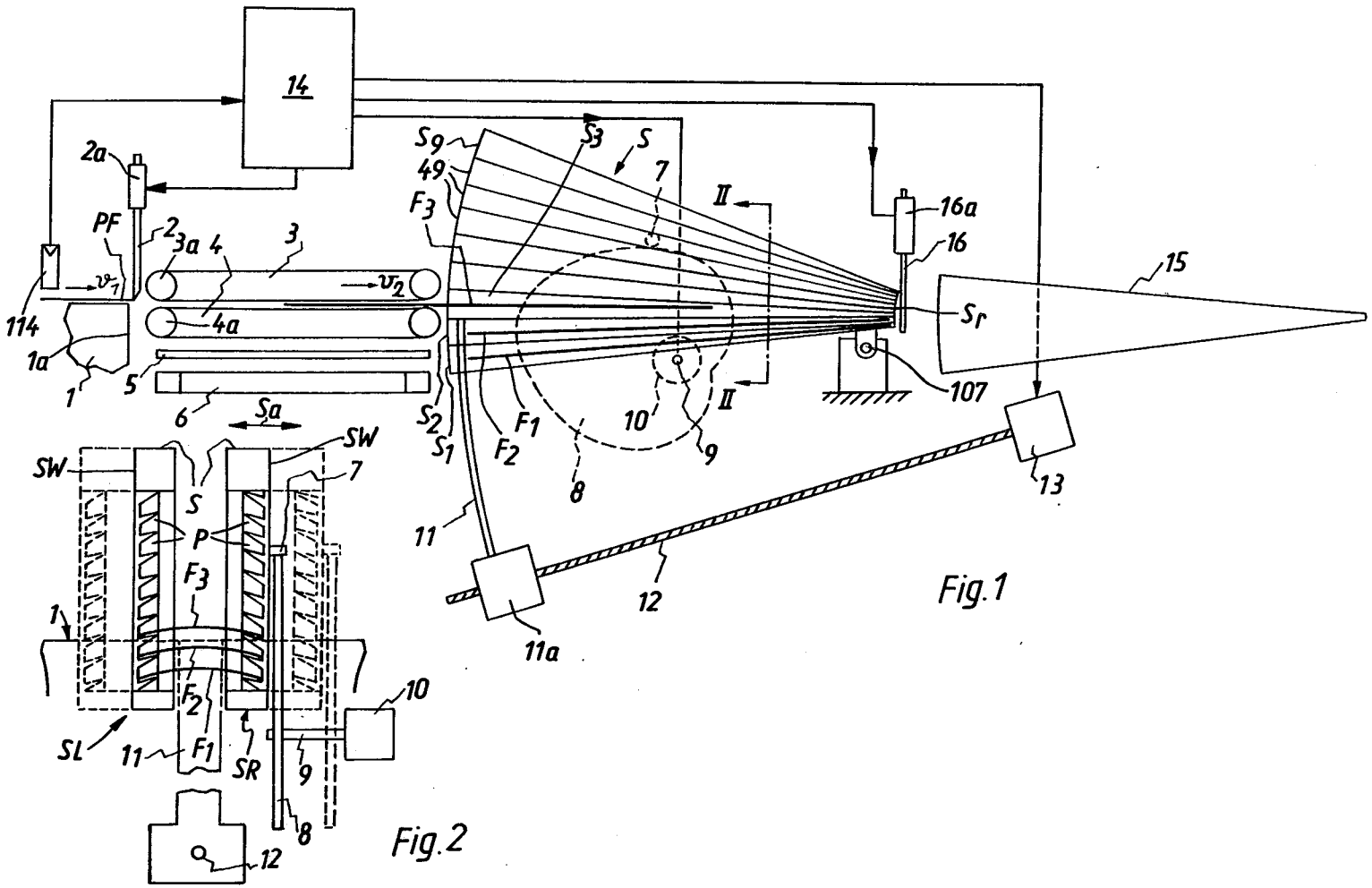
FIG. 1 is a schematic side elevational view of an apparatus which embodies one form of the invention, the means for expelling groups of film sections from the magazine being shown in the starting position.
FIG. 2 is an enlarged transverse vertical sectional view as seen in the direction of arrows from the line II—II of FIG. 1.
Figure 3:
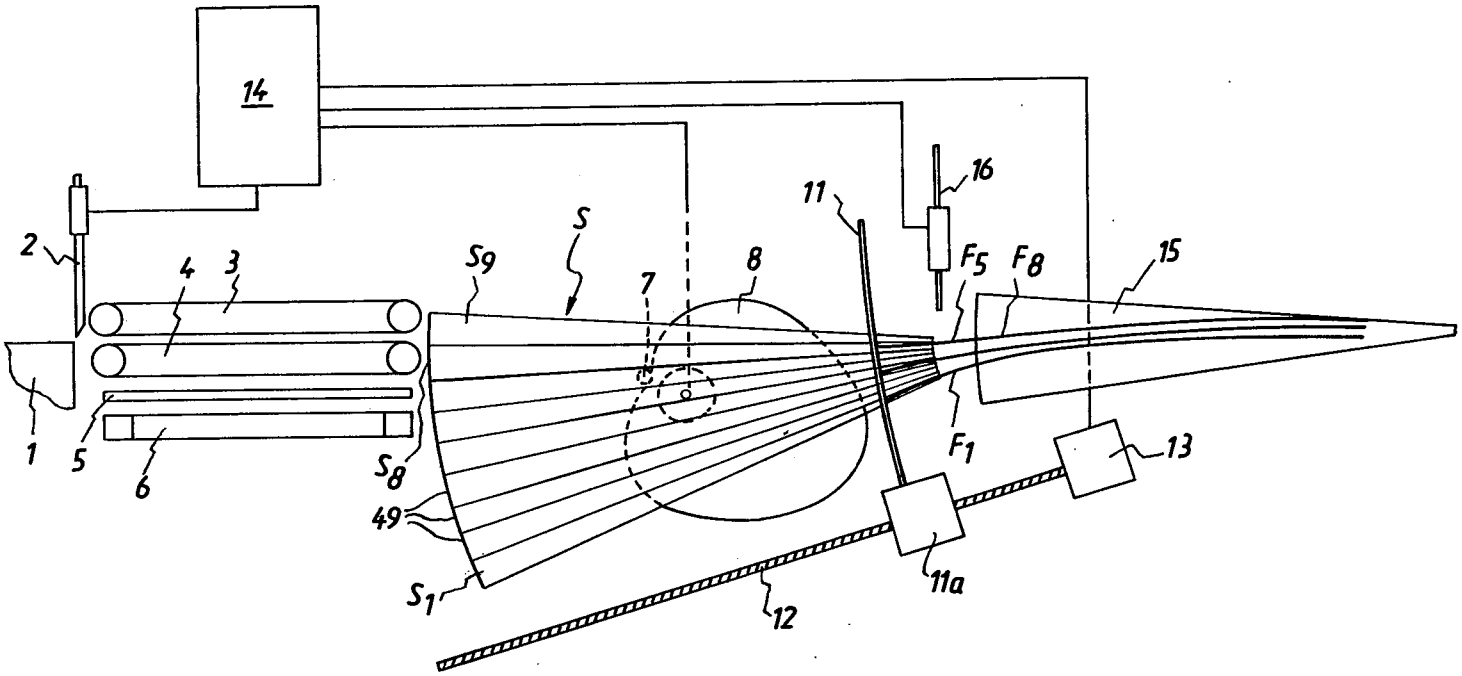
FIG. 3 shows the structure of FIG. 1 but with the expelling means for film sections in an intermediate position.

Referring first to FIGS. 1 to 3, there is shown an apparatus which is used for assembly or stacking of groups of elongated sections F of photographic films PF and for subsequent insertion or pocketing of stacked film sections in expandible envelopes or analogous receptacles 15. The sections F issue from a severing or subdividing unit 1 which may but need not form part of the assembling and inserting apparatus. The severing unit 1 comprises a reciprocable knife 2 which severs an elongated exposed and developed photographic film PF at regular intervals so that the film yields a succession of sections F1, F2, F3 . . . of desired length. For example, each section may include six film frames. The film PF is advanced at a speed *v*1 in the direction which is indicated by the arrow. The knife 2 performs working strokes at regular intervals if the speed *v*1 is constant or in response to detection of suitable markers on the film PF. The edge portion 1*a* of the severing unit 1 constitutes a counterknife for the mobile knife 2. At the time the film PF is severed by the knife 2, its leader is located between two endless transporting belts 3, 4 which are trained over pulleys 3*a*, 4*a* and at least one of which is driven at a speed *v*2 which exceeds the speed *v*1. Thus, those reaches of the belts 3, 4 which engage the leader slide relative to the film PF and automatically advance each freshly severed section forwardly and away from the remnant of the film PF as soon as the knife 2 completes a working (downward) stroke. The ratio of speeds *v*1 and *v*2 is preferably in the range of 1:1.5 to 1:2. FIG. 1 shows that the belts 3, 4 engage the rear portion of a film section F3 which is in the process of entering the registering compartment S3 of a fan-shaped magazine S located immediately downstream of the belts 3 and 4, as considered in the direction of forward movement of the film PF and sections F. The illustrated magazine S has nine compartments S1 to S9, and the width of each compartment decreases (i.e., each compartment tapers) in the direction of forward movement of film sections therein. The narrower (right-hand) end S*r* of the magazine S is open (i.e., the outlet of each compartment is open) but the sections F are prevented from advancing beyond the end S*r* by a retractible barrier 16 which is movable between an operative position (shown in FIG. 1) and a retracted position (shown in FIG. 3) by a suitable motor 16*a*. For example, the barrier 16 may constitute the reciprocable armature of an electromagnet.

The belt 4 of transporting means for the film sections F is adjacent to a ground glass plate 5 which is disposed between the belt 4 and a light source 6 (e.g., one or more elongated fluorescent lamps). The material of the belts 3 and 4 is transparent or translucent so that an attendant looking at the film section ($F_3$) between the belts 3, 4 (from above, as viewed in FIG. 1 or 3) can observe the frames of such section in order to determine whether or not the movements of film sections are properly synchronized with movements of photographic prints (not shown) which are processed in a second apparatus for the purpose of ultimately introducing each stack or group of prints into the envelope 15 containing the corresponding film sections. The manner in which the prints are processed forms no part of the invention. If suffices to say that the film PF is normally severed subsequent to the making of prints in a suitable copying machine. The images of film frames are exposed on a web of photographic paper which is thereupon severed to yield a succession of prints, and such prints are examined, trimmed (if necessary) and otherwise processed prior to insertion into an envelope 15 which is then ready to be sent to or picked up by a dealer or customer.

FIG. 2 shows that the magazine S comprises two mirror symmetrical halves SL and SR at least one of which is movable toward or away from the other (see the arrow S*a*) in order to enable the magazine to receive and stack film sections F of different widths. It is assumed that each of the two halves SL and SR is movable, at right angles to the direction of lengthwise movement of film sections F, between a first end position (indicated by solid lines) and a second end position (indicated by broken lines). The means for moving the halves SL and SR between such positions may include one or more feed screws, cam and follower means or any other suitable displacing means (not specifically shown). For example, the halves SL and SR can be moved toward and away from each other in a manner similar to that known for the helices of a developing box.

The lateral walls SW of the halves SL and SR have ribs or shelves P which constitute partitions between neighboring compartments S1 to S9 and on which the marginal portions of film sections F rest upon entry into the registering compartments. In order to stiffen the flexible sections F, the apparatus preferably comprises conical or otherwise configurated flexing elements (e.g., rolls, not specifically shown) which flex each section F about an axis which extends lengthwise between the marginal portions of the respective section. The arrangement may be such that the sections F are flexed to exhibit concave undersides and convex upper sides (this is shown in FIG. 2) or vice versa.

The means for effecting movements of the magazine S relative to the transporting belts 3, 4 so as to place successive or selected compartments into register with the path of oncoming film sections F comprises a horizontal follower 7 which is affixed to the half SR and tracks the periphery of a rotary heart-shaped cam 8 mounted on a shaft 9 which is driven by an electric motor 10 or another suitable prime mover. The halves SL and SR are pivotable about the axis of a fixed pivot member 107 which is parallel to the follower 7 and shaft 9 (i.e., normal to the direction of movement of sections F) and is secured to the magazine S close to the end S*r*. The follower 7 shares the movements of the half SR relative to the half SL, and the cam 8 is shiftable lengthwise of the shaft 9 so as to insure that its periphery is tracked by the follower 7 irrespective of the selected width of compartments S1 to S9.

The means for expelling a stack or group of nine overlapping film sections (or a smaller number of sections, depending on the length of the film PF which is to be severed by the unit 1) from the magazine S by way of the open end Sr includes a pusher 11 which is disposed in the space between the halves SL, SR of the magazine S (see FIG. 2) and whose tip is located at a level slightly below the path of lengthwise movement of film sections F between the transporting belts 3 and 4 when the pusher 11 is located in the starting position of FIG. 1. This pusher is mounted on a spindle nut 11*a* which meshes with a rotary feed screw 12 adapted to be driven by a motor 13. The inclination of the feed screw 12 is such that the upper end portion or tip of the pusher 11 moves upwardly while the spindle nut 11*a* advances toward the motor 13 (compare the FIGS. 1 and 3).

It is clear that the means for moving the pusher 11 to and from the starting position of FIG. 1 may be modified in a number of ways without departing from the spirit of the invention. For example, the pusher 11 can be moved by resorting to one or more toothed belts or chains, to a system of winches and cables, to a rack and pinion drive or others.

The means for actuating the mobile components of the apparatus in a predetermined sequence and/or at predetermined intervals includes a control unit 14 which is operatively connected with the means 2*a* for moving the mobile knife 2, with the motor 16*a*, with the motor 10 and with the motor 13. The control unit 14 preferably includes or constitutes a suitable electronic circuit the details of which form no part of the invention. The operation of this control unit is such that the cam 8 pivots the magazine S through a certain angle between successive working strokes of the knife 2 so as to insure that successively formed film sections enter the corresponding compartments of the magazine S. During filling of the magazine S with film sections F, the barrier 16 is held in the operative position of FIG. 1 and the pusher 11 is held in the starting position of FIG. 1.

The trailing portion of each film PF has a marker (e.g., a notch) which is detected by a suitable scanning device (e.g., a photoelectric cell 114) which transmits a signal to the corresponding input of the control unit 14. The unit 14 then causes the motor 10 to pivot the magazine S by an additional increment to thus insure that the uppermost filled compartment (e.g., $S_9$) of the magazine is located in the path of movement of the pusher 11. The control unit 14 thereupon transmits a signal which causes the motor 16*a* to retract the barrier 16 to the position shown in FIG. 3 and a signal which starts the motor 13 so that the pusher 11 advances toward and beyond the position shown in FIG. 3 whereby the film sections are expelled through the open end S*r* (outlets of the respective compartments) and into the envelope 15. For the sake of clarity, FIG. 3 merely shows three (F1, F5 and F8) of a maximum of nine film sections which can be introduced into an envelope 15 by resorting to the apparatus of FIGS. 1 to 3. When the introduction of a group of sections F into the adjacent envelope 15 is completed, the control unit 14 causes all parts to reassume their initial positions, i.e., the compartment S1 is in line with the path of movement of film sections between the transporting belts 3, 4, the barrier 16 reassumes the operative position of FIG. 1, the pusher 11 is returned to the starting position of FIG. 1, and the knife 2 is ready to descend as soon as the leader of a fresh photographic film (not shown) is advanced through a predetermined distance beyond the severing station. The filled envelope 15 of FIG. 3 is replaced with a fresh envelope before the barrier 16 is retracted upon completion of subdivision of the fresh photographic film. The filled envelope 15 can be removed automatically or by hand and is transferred to a locus where it can receive the corresponding prints (if any). Also, the envelope can be provided with information identifying the dealer or customer, the cost of the developing and printing work and/or others.

An important advantage of the improved apparatus is that related sections can be stacked regardless of whether or not they exhibit undesirable projections which are likely to enter the holes (perforations) of neighboring sections. This is due to the fact that the sections are introduced into discrete compartments of the magazine and are separated from each other by partitions P prior to introduction into the respective envelope. Moreover, the insertion of stacks or groups of related sections into the respective envelopes is effected without any relative movement between the overlapping sections of a group.

The envelopes 15 can be placed behind the magazine S by hand or by automatic feeding means, not shown.

It will be noted that the cross-sectional area of the inlet 49 of each compartment of the magazine S greatly exceeds the cross-sectional area of the respective outlet (at the end S*r*). The neighboring partitions P of each of the magazine halves SL and SR converge toward each other in the direction of forward movement of film sections.

Figure 5:
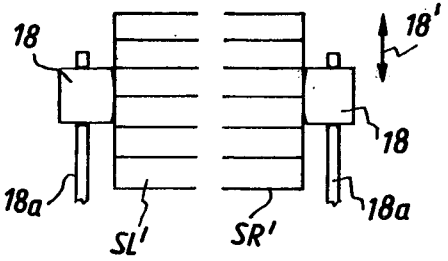
FIG. 5 is an enlarged transverse vertical sectional view as seen in the direction of arrows from the line V—V of FIG. 4.
Figure 4:
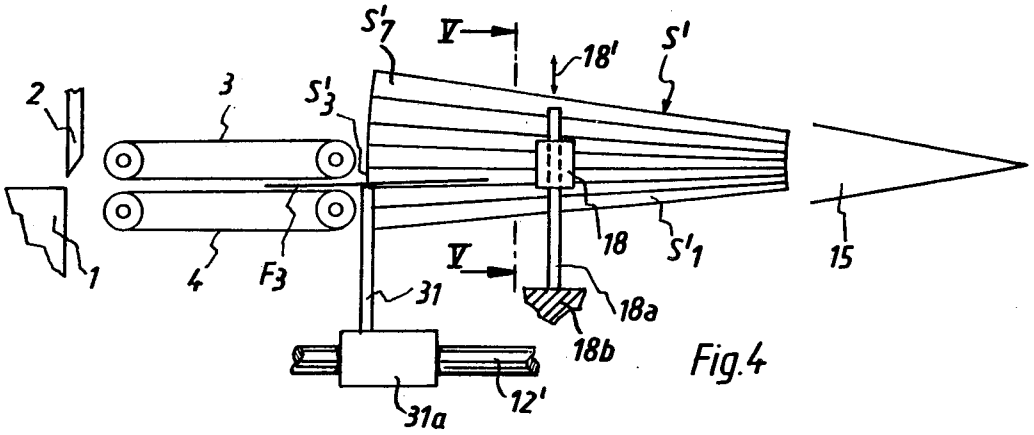
FIG. 4 is a fragmentary side elevational view of a second apparatus.

FIGS. 4 and 5 illustrate a portion of a second apparatus wherein the fan-shaped magazine S′ is movable or shiftable sideways (rather than pivotable) in order to place the relatively wide inlets of successive compartments S1′ to S7′ into the path of successive film sections F which are transported by the belts 3 and 4. The means for shifting the magazine S′ sideways comprises bearing members 18 which are affixed to the halves SL′ and SR′ of the magazine, rod-shaped displacing members **18*a* which extend through the bearing members 18, and motors 18*b* which can move the rods 18*a* in directions indicated by the double-headed arrow 18′. If the bearing members 18 are spindle nuts, the rods 18*a* constitute feed screws and the motors 18*b* serve to rotate the feed screws clockwise or counterclockwise. If the bearing members 18 are rigid with the respective rods 18*a*, these rods may constitute the piston rods of double-acting hydraulic or pneumatic cylinder and piston units (18*b*). The pusher 31 is rigid with a spindle nut 31*a* which is in mesh with a feed screw 12′. The latter is parallel to the path of movement of film sections F in the space between the transporting belts 3 and 4. The control unit which transmits signals to the motor for the knife 2, to the motor for the barrier (not shown in FIGS. 4–5) to the motors 18*b* and to the motor for the feed screw 12′** is not shown.

Figure 7:
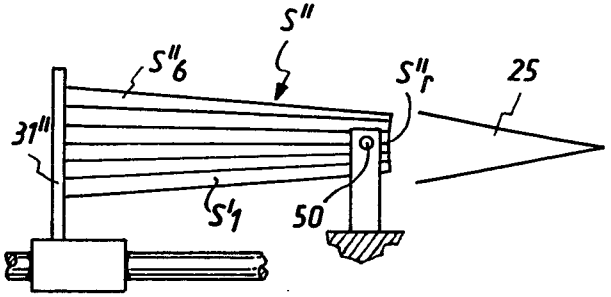
FIG. 7 is an end elevational view of the magazine as seen in the direction of arrow VII in FIG. 8.
Figure 6:
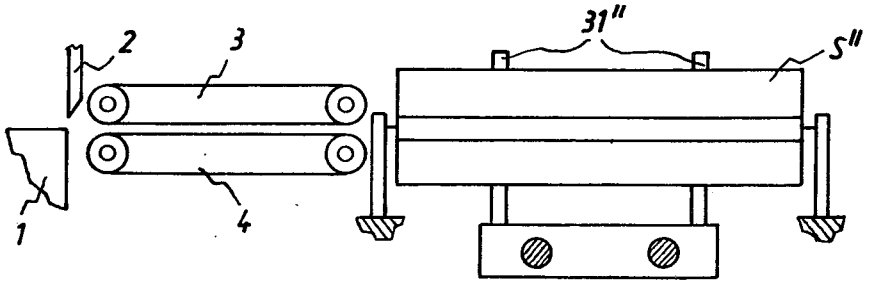
FIG. 6 is a fragmentary schematic side elevational view of a third apparatus.
Figure 8:
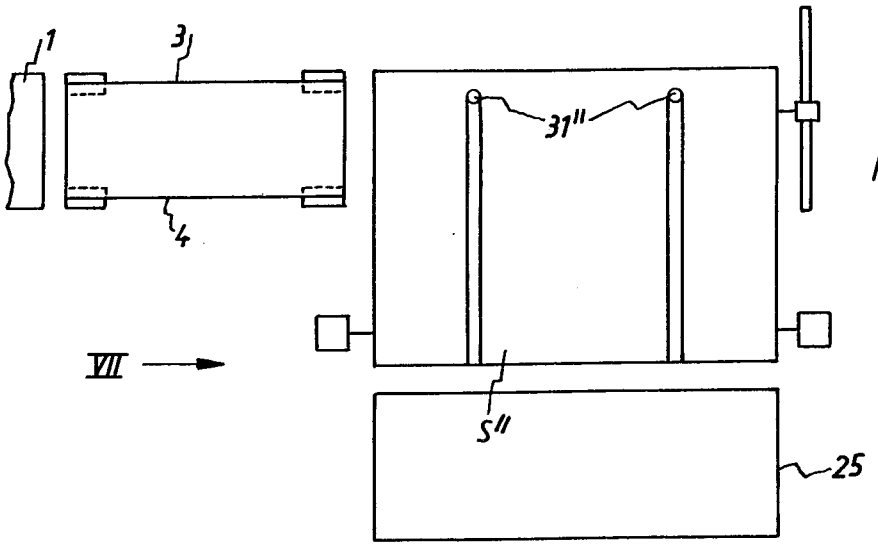
FIG. 8 is a plan view of the third apparatus.

FIGS. 6 to 8 illustrate a third embodiment of the improved apparatus. The main difference between this apparatus and the apparatus of FIGS. 1–3 and 4–5 is that the height of compartments S1″ to S6″ of the magazine S″ diminishes in a direction at right angles to the direction of forward movement of successive film sections. In other words, successive film sections enter the compartments of the magazine S″ at right angles to the plane of FIG. 7 and the pusher 31″ is located at one side of the magazine S″ to transfer a stack or group of overlapping film sections from the corresponding compartments into an envelope or receptacle 25 which is located at the other side of the magazine S″. Thus, the pusher 31″ and the discharge end Sr″ of the magazine S″ are located at the opposite sides of the path of movement of film sections into the registering compartments S1″ to S6″.

Figure 10:
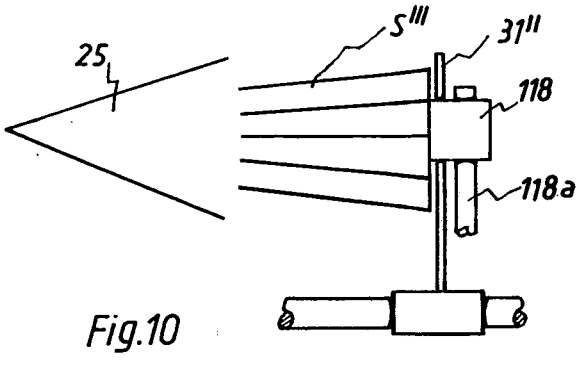
FIG. 10 is an end elevational view of the apparatus of FIG. 9.
Figure 9:
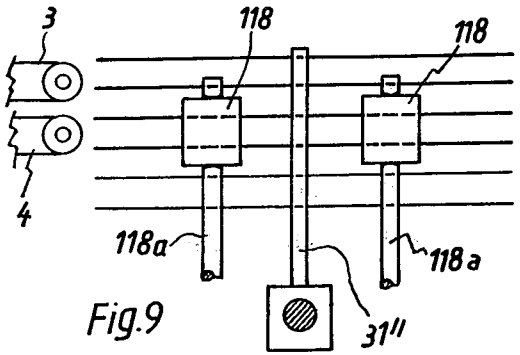
FIG. 9 is a fragmentary side elevational view of a fourth apparatus.

FIGS. 9 and 10 illustrate a modification of the apparatus which is shown in FIGS. 6 to 8. The main difference is that the magazine S‴ is shiftable sideways (analogously to the magazine S′ of FIGS. 4–5) in contrast to the magazine S″ which is pivotable (at 50) about a horizontal axis in the region of its discharge end Sr″. The means for moving the magazine S‴ includes parts 118, **118*a* which are analogous to the parts 18, 18*a* of the apparatus shown in FIGS. 4–5**.

The pusher 31″ of FIGS. 6–8 or 9–10 may comprise one or more prongs which are movable in suitable slots or recesses of the respective magazine S″ or S‴.

The improved apparatus is susceptible of many additional modifications. For example, the means for pivoting the magazine S or S″ may comprise a gear segment which is mounted on the magazine and meshes with a driven gear. Furthermore, the barrier can receive motion from the corresponding pusher, or vice versa. It is equally possible to omit the motor for the pusher and to shift the pusher by hand to and from its starting (or at least to or from the starting) position. Also, the number of compartments in the magazine can be selected at will, depending upon the length of photographic film and the desired length of film sections.

Still further, the apparatus may be modified by resorting to a fixedly mounted magazine and to transporting means which is movable relative to the fixed magazine so that it feeds successive film sections into different compartments of the magazine. For example, the belts 3, 4 can be mounted on a support which is pivotable at a locus close to the severing station so that the right-hand ends of the transporting reaches of the belts 3, 4 (as viewed in FIG. 1) can be moved into register with the inlets 49 of different compartments in the magazine. It is equally within the purview of the invention to move the transporting means and the magazine relative to each other or to move the transporting means alternately with the magazine, as long as such movements insure that each section enters a different compartment of the magazine. The structures which are shown in the drawing (i.e., wherein the magazine is movable relative to the transporting means) are preferred at this time because it is normally simpler to change the position of the magazine relative to driven belts or analogous transporting means, especially when the belts must receive successive sections of an elongated web of photographic film which is drawn off a supply reel and whose leader is severed at regular intervals to yield a series of sections.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. A method of inserting sections of elongated photographic films or the like into envelopes or analogous receptacles, comprising the steps of assembling successive pluralities of sections into discrete groups outside of the respective receptacles, including transporting successive sections of the respective plurality in a predetermined direction, arresting successive foremost sections and effecting a relative sidewise movement between each arrested section and the next foremost section such as is sufficient to enable the next foremost section to advance to a position previously occupied by the immediately preceeding section in which it at least partially overlaps the preceding section; and thereupon introducing each of the thus obtained groups into the respective receptacle, said assembling step further comprising maintaining the overlapping neighboring sections of each group out of contact with each other prior to said introducing step.

2. A method as defined in claim 1, further comprising the steps of moving an elongated web-like carrier of information lengthwise, and subdividing the carrier into a series of portions each of which constitutes one of said sections, each of said groups consisting of a plurality of related sections.

3. A method as defined in claim 1, wherein said introducing step comprises simultaneously advancing all arrested sections of a group in said direction toward and into the respective receptacle.

4. A method as defined in claim 1, wherein said introducing step comprises simultaneously advancing all arrested sections of a group toward and into the respective receptacle in a direction other than said predetermined direction.

5. A method as defined in claim 1, wherein said transporting step comprises transporting successive sections of each plurality along a predetermined path and said sidewise movement effecting step comprises moving successive foremost sections of the respective plurality sideways in a predetermined portion of said path so that the oncoming next-to-the-foremost sections are free to advance in said portion of said path and are thereby in at least partial register with the preceding sections.

6. Apparatus for inserting sections of elongated photographic films or the like into envelopes or analogous receptacles, comprising means for assembling successive pluralities of sections into discrete groups outside of the respective receptacles, including means for transporting successive sections of the respective plurality in a predetermined direction, means for arresting successive foremost sections and means for effecting a relative sidewise movement between each arrested section and the next foremost section to an extent which is sufficient to enable the next foremost section to advance to a position previously occupied by the immediately preceeding section in which it at least partially overlaps the preceding section; and means for introducing each of the thus obtained groups into the respective receptacles, said assembling means further comprising means for maintaining the overlapping neighboring sections of each group out of contact with each other prior to introduction of the group into the respective receptacle.

7. Apparatus as defined in claim 6, further comprising means for subdividing webs of flexible material into a succession of discrete portions each of which constitutes one of said sections, said transporting means comprising means for transporting successive sections from said subdividing means along a predetermined path and said means for maintaining including a magazine disposed in a portion of said path and arranged to temporarily store the sections of a group preparatory to introduction of such group into the respective receptacle.

8. Apparatus as defined in claim 7, wherein said magazine has a plurality of discrete compartments for reception of oncoming sections.

9. Apparatus as defined in claim 8, wherein said introducing means comprises means for simultaneously expelling all sections of a group from the corresponding compartments of said magazine into the respective receptacle.

10. Apparatus as defined in claim 8, wherein said means for effecting a relative movement between said magazine and said transporting means comprises means for pivoting said magazine between a plurality of positions in each of which a different compartment is located in said portion of said path.

11. Apparatus as defined in claim 10, further comprising means for supporting said magazine for pivotal movement about an axis which is normal to the direction of movement of sections along said path.

12. Apparatus as defined in claim 8, wherein each of said compartments has an inlet facing said transporting means and an outlet at one side of said portion of said path.

13. Apparatus as defined in claim 12, wherein each of said compartments tapers in a direction from the inlet toward the outlet thereof.

14. Apparatus as defined in claim 8, wherein each of said compartments has an inlet facing said transporting means and an outlet, and further comprising a retractable barrier adjacent to said outlets during introduction of sections into the compartments of said magazine, said introducing means including means for simultaneously expelling the sections of a group from said magazine by way of the outlets of the corresponding compartments subsequent to retraction of said barrier.

15. Apparatus as defined in claim 8, further comprising control means for operating said introducing means and said movement effecting means in a predetermined sequence.

16. Apparatus for inserting sections of elongated photographic films or the like into envelopes or analogous receptacles, comprising means for subdividing webs of flexible material into a succession of discrete portions each of which constitutes one of said sections; means for assembling successive pluralities of sections into discrete groups outside of the respective receptacles, including means for transporting successive sections from said subdividing means along a predetermined path, a magazine disposed in a portion of said path and arranged to temporarily store the sections of a group preparatory to introduction of such group into the respective receptacle, said magazine having a plurality of discrete compartments for reception of oncoming sections and each of said compartments having an inlet for entry of sections and an outlet, and means for effecting a relative movement between said magazine and said transporting means so as to insure that each section of a group enters a different compartment of said magazine; and means for introducing each of the thus obtained groups into the respective receptacle, including means for simultaneously expelling all sections of a group from the corresponding compartments of said magazine into the respective receptacle, said expelling means comprising pusher means operable to expel the sections of a group from the corresponding compartments by way of the respective outlets.

17. Apparatus as defined in claim 16, wherein the cross-sectional area of each of said inlets exceeds the cross-sectional area of the respective outlet.

18. Apparatus as defined in claim 17, wherein each of said compartments tapers in a direction from the respective inlet toward the respective outlet.

19. Apparatus for inserting sections of photographic films or the like into envelopes or analogous receptacles, comprising means for subdividing webs of flexible material into a succession of discrete portions each of which constitutes one of said sections; means for assembling successive pluralities of sections into discrete groups outside of the respective receptacles, including means for transporting successive sections from said subdividing means along a predetermined path, a magazine disposed in a portion of said path and arranged to temporarily store the sections of a group preparatory to introduction of such group into the respective receptacle, said magazine having a plurality of discrete compartments for reception of oncoming sections, and means for effecting a relative movement between said magazine and said transporting means so as to insure that each section of a group enters a different compartment of said magazine, said relative movement effecting means comprising means for pivoting said magazine between a plurality of positions in each of which a different compartment is located in said portion of said path, said pivoting means comprising driven cam means and follower means provided on said magazine and tracking said cam means; and means for introducing each of the thus obtained groups into the respective receptacle.

20. Apparatus for inserting sections of photographic films or the like into envelopes or analogous receptacles, comprising means for subdividing webs of flexible material into a succession of discrete portions each of which constitutes one of said sections; means for assembling successive pluralities of sections into discrete groups outside of the respective receptacles, including means for transporting successive sections from said subdividing means along a predetermined path, a magazine disposed in a portion of said path and arranged to temporarily store the sections of a group preparatory to introduction of such group into the respective receptacle, said magazine having a plurality of discrete compartments for reception of oncoming sections, and means for effecting a relative movement between said magazine and said transporting means so as to insure that each section of a group enters a different compartment of said magazine, said relative movement effecting means comprising means for shifting said magazine transversely of said path between a plurality of positions in each of which a different compartment is located in said portion of said path; and means for introducing each of the thus obtained groups into the respective receptacle.

21. Apparatus for inserting sections of photographic films or the like into envelopes or analogous receptacles, comprising means for subdividing webs of flexible material into a succession of discrete portions each of which constitutes one of said sections; means for assembling successive pluralities of sections into discrete groups outside of the respective receptacles, including means for transporting successive sections from said subdividing means along a predetermined path, a magazine disposed in a portion of said path and arranged to temporarily store the sections of a group preparatory to introduction of such group into the respective receptacle, said magazine having a plurality of discrete compartments for reception of oncoming sections and each compartment being bounded by two partitions and having an inlet and an outlet, said partitions converging in a direction from said inlet toward said outlet and said outlet being located behind said inlet, as considered in the direction of transport of sections along said path, and means for effecting a relative movement between said magazine and said transporting means so as to insure that each section of a group enters a different compartment of said magazine; and means for introducing each of the thus obtained groups into the respective receptacle.

* * * * *

UNITED STATES PATENT AND TRADEMARK OFFICE

CERTIFICATE OF CORRECTION

PATENT NO. : 4,073,118

DATED : February 14, 1978

INVENTOR(S) : Klaus Weber; Heinz Ludemann; Andreas Schubert; & Karel Pustka

It is certified that error appears in the above-identified patent and that said Letters Patent are hereby corrected as shown below:

Col. 10, line 16, in Claim 14, "and further" should be --said arresting means--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*